US006681594B1

(12) United States Patent
Nelson

(10) Patent No.: US 6,681,594 B1
(45) Date of Patent: Jan. 27, 2004

(54) REFRIGERATION APPARATUS FOR COOLING A BEVERAGE

(75) Inventor: Patrick L. Nelson, Sun Prairie, WI (US)

(73) Assignee: Dispensing Systems International LLC, Madison, WI (US)

( * ) Notice: Subject to any disclaimer, the term of this patent is extended or adjusted under 35 U.S.C. 154(b) by 0 days.

(21) Appl. No.: 10/317,257

(22) Filed: Dec. 11, 2002

(51) Int. Cl.[7] ..... F25B 43/02
(52) U.S. Cl. ..... 62/471; 62/389
(58) Field of Search ..... 62/471, 84, 470, 62/389

(56) References Cited

U.S. PATENT DOCUMENTS

| | | | | |
|---|---|---|---|---|
| 3,435,631 A | * | 4/1969 | Wood, Jr. | 62/305 |
| 3,876,107 A | | 4/1975 | Meindl et al. | |
| 3,881,636 A | | 5/1975 | D'Aubreby | |
| 3,978,900 A | | 9/1976 | Mencacci et al. | |
| 4,560,089 A | | 12/1985 | McMillin et al. | |
| 5,566,732 A | | 10/1996 | Nelson | |
| 5,603,363 A | | 2/1997 | Nelson | |
| 5,605,058 A | * | 2/1997 | Kurachi et al. | 62/503 |
| 6,156,627 A | * | 12/2000 | Zhang et al. | 62/471 |
| 6,237,652 B1 | | 5/2001 | Nelson | |

FOREIGN PATENT DOCUMENTS

| | | | |
|---|---|---|---|
| DE | 3435725 A1 | | 4/1985 |
| EP | 0 861 801 A1 | | 2/1998 |
| GB | 2231133 | * | 11/1990 |

* cited by examiner

*Primary Examiner*—William E. Tapolcai
(74) *Attorney, Agent, or Firm*—George E. Haas; Quarles & Brady LLP

(57) ABSTRACT

An apparatus for cooling a fluid, such as a beverage, includes a housing with a closed chamber that forms bath of a refrigerant. A conduit for the beverage is coiled in the chamber and immersed in the refrigerant to transfer heat from the beverage to the refrigerant. The housing chamber is connected to a compressor and condenser of a standard refrigeration system to extract heat from the refrigerant drawn from the chamber and return the refrigerant to the housing. The refrigerant bath forms an efficient mechanism for cooling the beverage as it flows through the apparatus without requiring the beverage to remain stationary for a period of time.

27 Claims, 2 Drawing Sheets

REFRIGERATION APPARATUS FOR COOLING A BEVERAGE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to refrigeration equipment for cooling a fluid which flows through the equipment, and more particularly to such refrigeration equipment for use in beverage dispensing systems.

2. Description of the Related Art

It is common for carbonated beverages, such as soda and beer, to be supplied in a sealed canister or keg, that is connected to a tap at the food service establishment. Pressurized gas, typically carbon dioxide, is injected into the keg to force the liquid beverage through an outlet tube to the tap from which it is dispensed into cups, mugs and pitchers of various sizes.

The canisters and kegs usually are stored in a refrigerator while connected to the tap. However, the canisters and kegs may be stored unrefrigerated until needed and thus contain relatively warm beverage when initially connected to the tap. Although some beverage dispensers, especially those for soda, have ice water baths with coils through which the beverage flows between the keg and the tap, that may not adequately chill the beverage in large volume dispensing establishments, such as sports venues, or when a new unrefrigerated keg is tapped.

Therefore, it is desirable to provide a refrigeration system that is capable of rapidly chilling a beverage as it flows continuously through a supply line between the supply keg and a dispensing tap.

SUMMARY OF THE INVENTION

An apparatus for cooling a fluid has a housing that defines a closed chamber which contains a conventional refrigerant, such as R-134*a*. The housing has an inlet through which the refrigerant enters the chamber and an outlet through which the refrigerant exits an upper section of the chamber. A conduit for the fluid is within the closed chamber and in contact with the refrigerant. The conduit has a fluid inlet and a fluid outlet to which devices external to the housing can be connected to supply the fluid to and receive the fluid from the conduit.

As the fluid flows through the conduit, heat is transferred to the refrigerant, thereby lowering the temperature of the fluid. The refrigerant bath in the housing chamber forms an effective mechanism for cooling the fluid to a desired temperature as the fluid flows through the conduit, without requiring the fluid to remain stationary in the conduit. However, it is not necessary that the fluid move continuously through the conduit. A temperature control system preferably regulates the temperature of the refrigerant bath thereby preventing fluid that remains stationary in the conduit from freezing.

In the preferred embodiment, a compressor and condenser of types commonly used in refrigeration systems are connected in a circuit between the inlet and outlet of the housing. These components remove heat from the refrigerant drawn to them from the housing and return the refrigerant to the closed chamber thus completing a standard refrigeration cycle. Oil contained in the compressor for lubrication often is carried by the refrigerant into the chamber of the housing. An oil return conduit connected between the bottom section of the housing and a point between the outlet of the housing and the compressor to provide a path through which the oil is returned to the compressor.

The present apparatus is particularly suited for cooling a beverage that is flowing between a supply container and a dispenser. The apparatus in this application also can be provided with another conduit within the closed chamber of the housing to cool a second fluid that is used to maintain the temperature of the beverage at the dispenser. For example, a liquid containing glycol can be circulated through this other conduit and then around a beverage reservoir at the dispenser to maintain the beverage at a desired dispensing temperature.

DETAILED DESCRIPTION OF THE INVENTION

Figure 1:
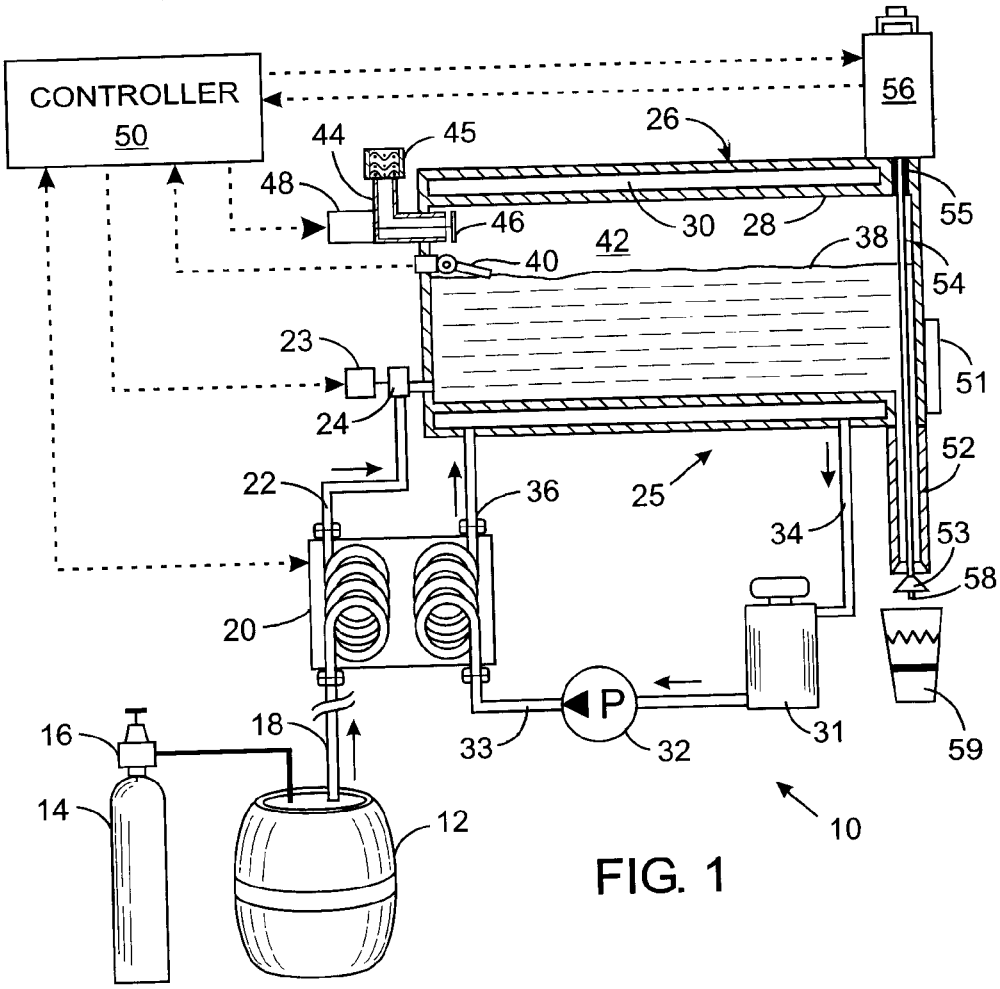
FIG. 1 is a schematic diagram of a beverage dispensing system incorporating the present invention.

With initial reference to FIG. 1, a beverage dispensing system 10 receives a fully mixed carbonated beverage, such as beer or soda, from a keg 12. The keg is stored in a refrigerator which in the case of beer maintains the keg at a temperature of approximately 38° F. (3° C.). A source of pressurized gas, for example a cylinder 14 of carbon dioxide, is connected by a pressure regulator 16 to an inlet of the keg 12. The pressure regulator 16 controls the pressure of the carbon dioxide which is applied to the keg 12 and typically that pressure is set at 15 psi (1 bar) for beer. Alternatively, a compressor or other apparatus can be used to apply pressurized gas to the inlet of the keg 12. The keg pressure is commonly referred to as the "rack" pressure, and cylinder 14 can be connected to several kegs within the establishment at which the beverages are being served. The application of pressure to the keg 12 forces the beverage from an outlet through a supply conduit 18.

The supply conduit 18 is connected to a beverage inlet of a chiller 20 which lowers the temperature of the beverage to a desired dispensing temperature. The chiller typically is located near the location at which the keg 12 is stored which may be some distance from the place at which the beverage is dispensed into serving containers. After being chilled, the beverage flows through conduit 22 to an inlet valve 24 of a beverage reservoir 26 which is part of a dispenser 25. The inlet valve 24 is operated by a solenoid actuator 23 in response to an electric signal from a controller 50.

An exterior wall of the reservoir 26 forms an outer cavity 30 extending around the inner chamber 28. Chilled liquid coolant, such as glycol, is circulated through this outer cavity 30 to maintain the contents of the inner chamber 28 at the proper temperature, e.g. approximately 38° F. (3° C.). Baffles may be provided within the outer cavity 30 to ensure that the coolant flows completely around the inner chamber 28 to maintain the beverage 38 therein at a relatively uniform temperature. The coolant flows from the outer cavity 30 via an outlet line 34 into a coolant tank 31 from which a pump 32 forces the coolant through another coil within the chiller 20. This cools the coolant to the desired temperature, typically 23° F. to 28° F. (−2° C. to −5° C.) for beer, and the chilled coolant is returned through a supply conduit 36 to the outer cavity 30 of the reservoir 26. By using a coolant with a relatively low freezing point, such as glycol, the temperature of the liquid in the outer cavity 30 can be lower than that of ice water baths of prior beverage dispensers. This counteracts heat loss to the ambient environment of the dispenser 25.

The beverage 38 partially fills the inner chamber 28 of the reservoir 26 to a height that is detected by a level sensor 40. The upper portion 42 of the closed inner chamber 28 is filled with a mixture of air and carbon dioxide which outgases from the beverage. A breather tube 44 extends between the inner chamber 28 and the ambient atmosphere and has a pressure control valve 46 that is operated by an actuator 48. As will be described, the pressure control valve 46 is opened to vent the gas, beverage foam, or both from the inner chamber 28 into the ambient environment. A filter 45 may be provided to trap any contaminate from entering the reservoir through the breather tube 44.

The valves 24 and 46 are operated electrically by signals from the controller 50 in response to the signal from the level sensor 40. The controller 50 has a standard hardware design that is based on a microcomputer and a memory in which the programs and data for execution by the microcomputer are stored. The microcomputer is connected input and output circuits that interface the controller to switches, sensors and valves of the beverage dispenser 10. The software executed by the controller responds to those input signals by operating the valves 24 and 46, as will be described.

With continuing reference to FIG. 1, the reservoir 26 includes a dispensing spout 52 extending downwardly there from. The flow of beverage through the spout 52 is controlled by a movable dispensing valve element 53 that is mounted at the lower end of a tube which extends vertically through the spout 52 and the reservoir 26. An upper end of the tube 54 passes through a seal 55 and is connected to an actuator 56, which raises and lowers the tube. That motion brings the dispensing valve element 53 into and out of engagement with the spout 52 to allow beverage to flow into a serving container 59 placed there beneath. The actuator 56 is operated by signals from the controller 50, as will be described.

A switch 58 is mounted on the valve element 53 and is depressed by the bottom of a serving container 59 placed under the spout 52 and raised upward. The switch 58 is connected by a pair of wires which runs through the tube 54, emerge from the actuator 56 and extend to an input of the controller 50.

While the beverage 38 is being held in the reservoir 26 the pressure control valve 46 is closed so that the reservoir is sealed from the atmosphere surrounding the dispenser. When it is desired to dispense the beverage into a drinking container 59, the operator presses a pushbutton switch on a control panel 51 to designate the size of the serving container. The container 59 then is placed under the spout 52 and moved upward to activate a switch 58 mounted on the valve element 53 which sends a signal to the controller 50. The controller 50 reacts by opening the pressure control valve 46 to vent the pressure within the inner chamber 28 through the breather tube 44 to the outside atmosphere. This decreases the pressure within inner chamber 28 from the holding pressure to a lower dispensing pressure which is substantially equal to atmospheric pressure. After an interval of time sufficient to allow that pressure reduction, the controller 50 powers the actuator 56 to open the valve element 53 for a predefined period of time required to fill the serving container 59. Lowering the pressure of the beverage prior to opening the spout valve element 53 reduces foaming within the serving container 59.

As the beverage flows into the serving container, the level of liquid in the inner chamber 28 lowers, which is detected by level sensor 40. The controller 50 responds to the signal from the level sensor 40 by opening the inlet valve 24 to replenish the reservoir 26 with beverage from the keg 12. The additional beverage drawn into the reservoir 26 from the keg 12 flows through the chiller 20 to ensure that the beverage is at the desired serving temperature.

Figure 2:
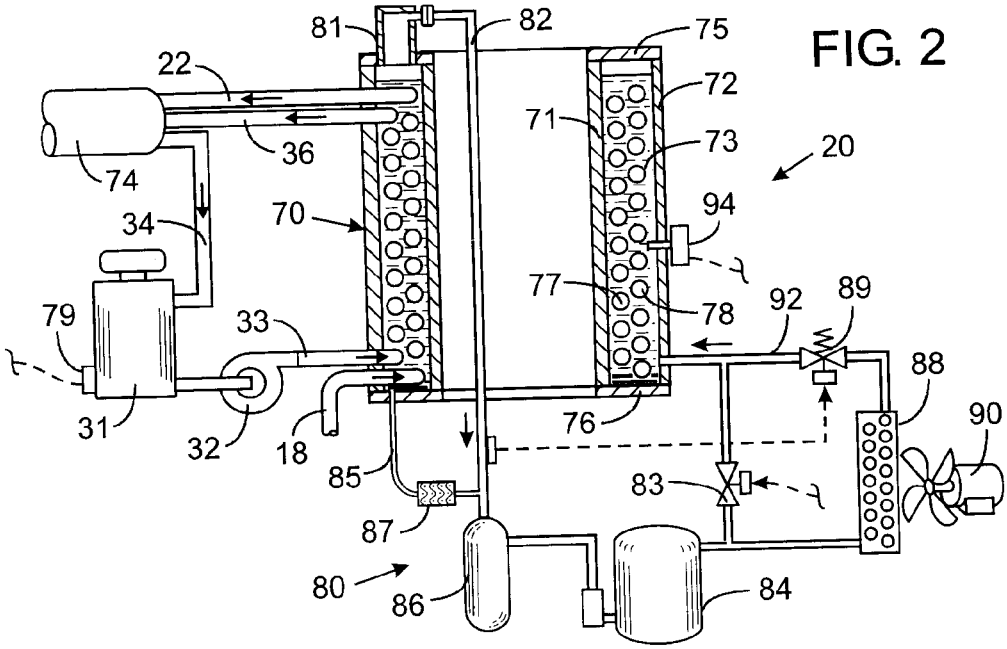
FIG. 2 is a detailed diagram of the chiller in FIG. 1.

As shown in FIG. 2, the chiller 20 has an annular cylindrical housing 70 with coaxial inner and outer cylindrical walls 71 and 72 that are spaced apart to form a chamber 73 there between. The top and bottom ends of the chamber 73 are sealed by flat annular caps 75 and 76 extending between and welded to the inner and outer cylindrical walls 71 and 72. First and second coils 77 and 78 of tubing are wound within the inner chamber 73 and have inlets and outlets at the opposite ends of the housing 70. The inlet to the first tubing coil 77 is connected to the supply conduit 18 which carries the beverage from the keg 12 and the outlet of the first tubing coil is coupled to the beverage conduit 22 leading to the reservoir 26. The second tubing coil 78 serves to chill the coolant for the reservoir 26. For that purpose, the outlet conduit 33 of the pump 32 is connected to the inlet of the second tubing coil 78, which has an outlet attached to the coolant supply conduit 36 to the reservoir 26.

The beverage conduit 22, coolant supply conduit 36 and the coolant return conduit 34 extend through an outer sheath 74 between the chiller 20 and the reservoir 26. The outer sheath 74 causes the supply conduit 36 to be in substantial contact with the beverage conduit 22 so that the chilled coolant maintains the beverage to the desired serving temperature. Alternatively the outer sheath 74 can form part of the coolant supply conduit 36 so that the coolant flows around the beverage conduit 22 extending through the sheath. The coolant return conduit 34 feds the coolant into the tank 31 which has a first temperature sensor 79 that provides an input signal to the controller 50.

The chiller housing 70 is filled with a refrigerant, which surrounds the first and second tubing coils 77 and 78 thus providing a refrigerant bath in which those coils are submerged. As used herein, a refrigerant is a substance Which transfers heat by changing between vapor and liquid states. Any commercially available refrigerant may be used, such as for example R-11, R-12, R-22, R-123, R-134a, R-401a, R-401b, R-404A, R-408A, R-409A, R-502, or R-717 (ammonia) as designated by the American Society of Heating Refrigeration and Air Conditioning Engineers (ASHRAE). As the beverage and coolant flow through the respective tubing coils 77 and 78, heat is transferred from those liquids to the refrigerant, thereby converting the refrigerant from liquid phase to vapor phase. The chiller housing 70 thus functions as an evaporator of a refrigeration system. A second temperature sensor 94 is mounted to the chiller housing 70 to provide an input signal indicating the temperature of the refrigerant therein. Because the temperature of the refrigerant is related to its pressure, the second temperature sensor 94 could be replaced by a pressure probe to provide an input signal to the controller 50.

In the orientation of the chiller 20 depicted in FIG. 2, the vapor phase refrigerant travels to the top section of the housing 70 and into an outlet formed by a low velocity stack 81. The low velocity stack 81 calms the bath of liquid refrigerant in the housing 70, thereby preventing a high velocity fluid flow from the chamber 73 into a return conduit 82. Such high velocity flow could carry the liquid refrigerant to the refrigerant condensing unit 80. It is desirable that refrigerant in only the vapor phase enter the return conduit 82 in order to maximize the cooling function of the chiller 20.

As a result, refrigerant vapor is drawn from the low velocity stack 81 through the return conduit 82 into the refrigerant condensing unit 80. Specifically the refrigerant vapor enters an accumulator 86 from which it continues to flow to a conventional compressor 84 that has the outlet connected to a condenser 88. The condenser 88 is a coil through which a motorized fan assembly 90 blows air to remove heat from the refrigerant flowing therein. That transfer of heat and the increased pressure converts the refrigerant from vapor phase to liquid phase. The liquid refrigerant then flows from the condenser 88 through a conventional thermal expansion valve 89 and a return conduit 92 connected to an inlet of the chamber 73 at a bottom section of the chiller housing 70 thereby completing a standard refrigeration cycle. A bypass valve 83 is connected between the outlet of the compressor 84 and the return conduit 92. The bypass valve 83 is driven by a stepper motor that is operated by the controller 50.

The dispensing system 10 is designed such that the compressor 84 runs continuously. The controller 50 regulates the temperature of the beverage and the coolant by controlling the temperature, or pressure, of the refrigerant within the chiller housing 70. The signal from sensor 94 indicates the value of that parameter and the controller 50 responds to that signal by operating the bypass valve 83. Opening the bypass valve 83 allows hot refrigerant vapor to enter the return conduit 92, thereby flowing to the chiller housing 70 and increasing the temperature of the refrigerant therein. Reducing the bypass valve opening, decreases the amount of hot refrigerant vapor entering the return conduit 92 which lowers the refrigerant temperature in the chiller housing 70. Operation of the bypass valve 83 controls the heat load on the system. When the flow rate of beverage is relatively low, the bypass valve is opened wide to increase the system heat load. When large amounts of beverage are being dispensed the bypass valve 83 is closed so that the chiller 20 will properly cool beverage rapidly flowing through the coil 77. Alternatively the controller 50 can turn off the compressor 84 during periods of low beverage flow as indicated by a refrigerant temperature in the chiller housing 70 that is below a defined level.

During periods of high volume beverage dispensing, the controller monitors the temperature of the coolant in the tank 31 as indicated by the first temperature sensor 79. This indication is more representative of the dispensing temperature of the beverage. However, control of the refrigeration system still must employ the temperature signal from the second sensor 94, as that signal indicates the temperature of the refrigerant and is required to prevent the beverage from freezing in the chiller 20.

The velocity of the refrigerant vapor flowing from the chiller housing 70 in conduit 82 is relatively slow compared to conventional refrigeration systems in order to prevent liquid refrigerant from being drawn from the chiller housing 70. Consequently, that refrigerant vapor flow does not carry compressor oil that has entered the chiller housing from the refrigerant condensing unit 80 and that oil tends to accumulate at the bottom of the chiller housing 70 because the oil is denser than the refrigerant. If this oil is allowed to accumulate in the chiller housing, the compressor 84 will not be properly lubricated and eventually will seize-up. To avoid this problem, a small oil return tube 85 with a filter 87 is provided to drain the oil from the bottom of the chiller housing 70, and return it to the compressor 84. The pressure drop between the chiller 70 and the accumulator 86, created by the compressor 84, draws the oil from the chiller 20 into the compressor. The small diameter of the oil return tube 85 precludes a significant amount of liquid refrigerant from flowing there through.

By flooding the interior of the chiller housing 70 with the refrigerant, all the refrigerant therein has the substantially same temperature and a thermal gradient within the chiller is virtually eliminated. As a result, the entire lengths of the tubing coils 77 and 78 for the beverage and coolant are exposed to the same external temperature and thus the temperature of each of those fluids at the chiller outlets can be accurately controlled. This design also enables a continuous flow of beverage through the beverage system 10 to be cooled to the desired dispensing temperature, thus making the system advantageous for use at large volume dispensing establishments. This eliminates the need for the beverage to remain stationary in the chiller or reservoir 26 in order to be cooled properly. The coolant jacket surrounding the reservoir 26 maintain that temperature of the beverage.

Figure 3:
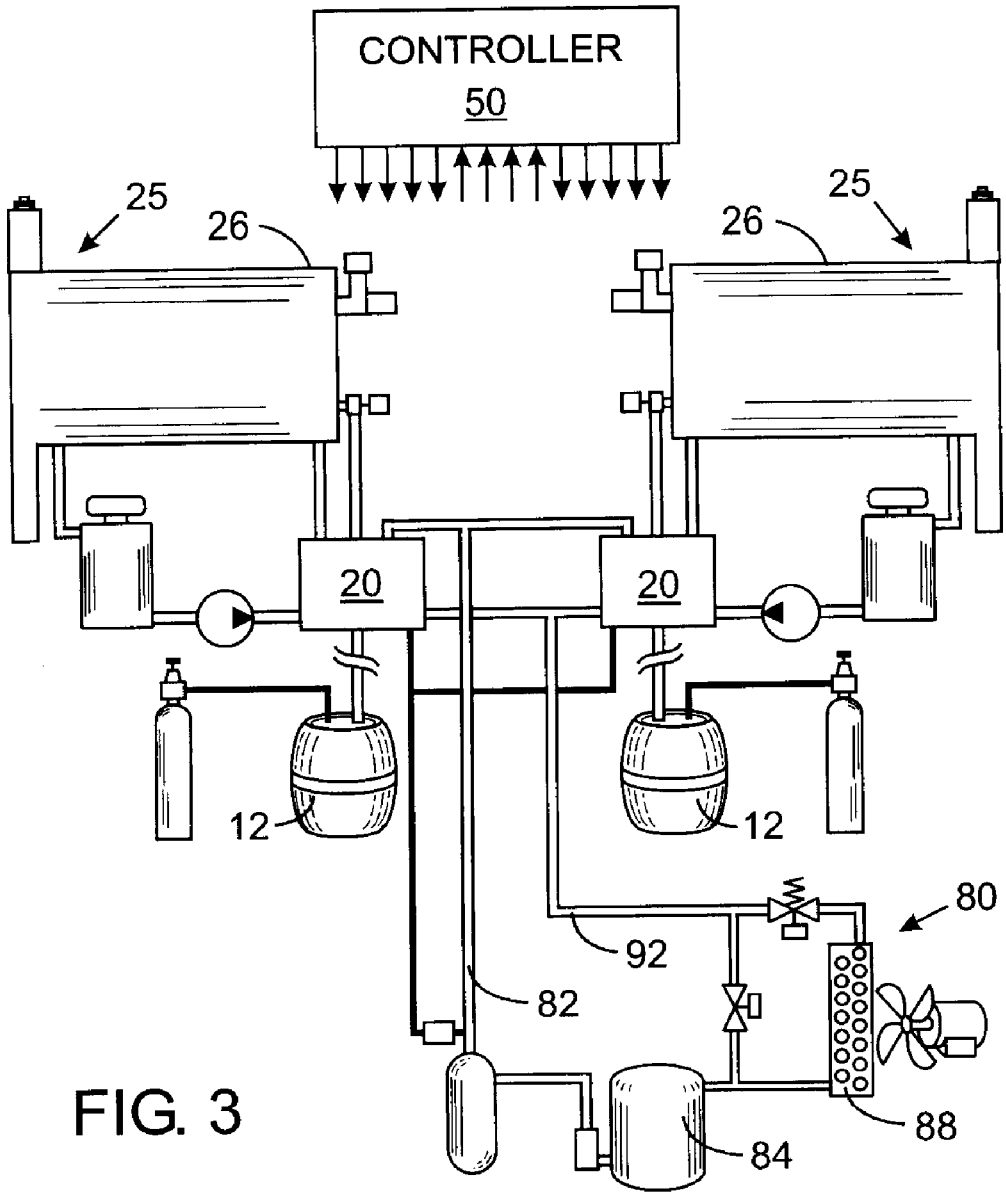
FIG. 3 is a diagram of a beverage dispensing system with a plurality of dispensers.

With reference to FIG. 3, a single refrigerant condensing unit 80 can be connected via conduits 82 and 92 to several chillers 20 for different beverages. Specifically, different beverages are stored in kegs 12, each of which is connected through a separate chiller 20 to individual dispensers 25 for each beverage. Alternatively, multiple beverage and coolant coils 77 and 78 can be placed inside the same chiller housing 70 to service several beverage dispensers 25.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

I claim:

1. An apparatus for cooling a fluid comprising:

a refrigerant;

a housing defining a closed chamber which contains the refrigerant, the housing having a bottom section and an upper section with an outlet through which the refrigerant exits the closed chamber, the housing includes an inlet through which the refrigerant enters the closed chamber;

a first conduit in contact with the refrigerant within the closed chamber, and having a fluid inlet for receiving the fluid from a source and having a fluid outlet;

a compressor having a refrigerant inlet coupled to the housing outlet and having a refrigerant outlet;

a condenser connected between the refrigerant outlet of the compressor and the inlet of the housing; and an oil return conduit connected to the bottom section of the housing and to the refrigerant inlet of the compressor.

2. The apparatus as recited in claim 1 wherein the housing comprises an inner cylindrical wall and an outer cylindrical wall that are spaced apart to define the closed chamber there between; and first and second end walls extending between the inner cylindrical wall and the outer cylindrical wall.

3. The apparatus as recited in claim 2 wherein the first conduit is wound as a coil around the inner cylindrical wall.

4. The apparatus as recited in claim 1 wherein the outlet of the housing comprises low velocity stack which restricts fluid flowing through the outlet to being substantially in only a vapor phase.

5. The apparatus as recited in claim 1 further comprising a second conduit within the closed chamber and in contact with the refrigerant for carrying another fluid through the housing.

6. The apparatus as recited in claim 1 further comprising a bypass valve connected between the refrigerant outlet of the compressor and the inlet of the housing.

7. The apparatus as recited in claim 6 further comprising:

a sensor which senses a characteristic of the refrigerant in the closed chamber; and a controller connected to the sensor and the bypass valve, wherein the controller responds to the characteristic of the refrigerant by operating the bypass valve to control temperature of the refrigerant in the closed chamber.

8. The apparatus as recited in claim 7 wherein the characteristic of the refrigerant is selected from the group consisting of temperature and pressure.

9. The apparatus as recited in claim 1 wherein the refrigerant is selected from the group consisting of R-11, R-12, R-22, R-123, R-134a, R-401a, R-401b, R-404A, R-408A, R-409A, R-502, and R-717.

10. The apparatus as recited in claim 1 further comprising an accumulator coupling the outlet of the housing to the compressor.

11. An apparatus for cooling fluids comprising:

a refrigerant;

a first housing defining a first closed chamber which contains the refrigerant, the first housing having a bottom section and an upper section with a first outlet through which the refrigerant exits the first closed chamber, the first housing includes a first inlet through which the refrigerant enters the first closed chamber;

a first conduit in contact with the refrigerant within the first closed chamber, and having a first fluid inlet for receiving a first fluid and having a first fluid outlet;

a second housing defining a second closed chamber which contains the refrigerant, the second housing having a bottom section and an upper section with a second outlet through which the refrigerant exits the second closed chamber, the second housing includes a second inlet through which the refrigerant enters the second closed chamber;

a second conduit in contact with the refrigerant within the second closed chamber, and having a second fluid inlet for receiving a second fluid and having a second fluid outlet;

a compressor having a refrigerant inlet coupled to the first and second outlets and having a refrigerant outlet;

a condenser connected between the refrigerant outlet of the compressor and the first and second inlets; and an oil return conduit assembly connected to the bottom sections of the first and second housings and to the refrigerant inlet of the compressor.

12. The apparatus as recited in claim 11 further comprising a bypass valve connected between the refrigerant outlet of the compressor and the inlet of the housing.

13. The apparatus as recited in claim 12 further comprising:

a sensor which senses a characteristic of the refrigerant in the closed chamber; and a controller connected to the sensor and the bypass valve, wherein the controller responds to the characteristic of the refrigerant by operating the bypass valve to control temperature of the refrigerant in the closed chamber.

14. An apparatus for cooling a beverage comprising:

a refrigerant;

a housing defining a closed chamber which contains the refrigerant, the housing having a bottom section and an upper section with an outlet through which the refrigerant exits the closed chamber, the housing includes an inlet through which the refrigerant enters the closed chamber;

a first conduit in contact with the refrigerant within the closed chamber, the first conduit having a beverage inlet for receiving the beverage and having a beverage outlet;

a refrigerant condensing unit having a refrigerant inlet coupled to the outlet of the housing and a refrigerant outlet coupled to the inlet of the housing and converting the refrigerant from vapor phase to liquid phase;

a controller operably connected to control operation of the refrigerant condensing unit; and an oil return conduit connected to the bottom section of the housing and to refrigerant inlet of the refrigerant condensing unit.

15. The apparatus as recited in claim 14 wherein the outlet of the housing comprises low velocity stack which restricts fluid flowing from the closed chamber to being substantially in only a vapor phase.

16. The apparatus as recited in claim 14 wherein the refrigerant condensing unit comprises:

a compressor coupled to the outlet of the housing and having a refrigerant outlet a condenser connected between the refrigerant outlet of the compressor and the inlet of the housing.

17. The apparatus as recited in claim 16 further comprising an accumulator coupling the outlet of the housing to the compressor.

18. The apparatus as recited in claim 16 further comprising a bypass valve connected between the refrigerant outlet of the compressor and the inlet of the housing, wherein the bypass valve is operated by the controller.

19. The apparatus as recited in claim 16 wherein the controller controls operation of the compressor.

20. The apparatus as recited in claim 14 wherein the refrigerant is selected from the group consisting of R-11, R-12, R-22, R-123, R-134a, R-401a, R-401b, R-404A, R-408A, R-409A, R-502, and R-717.

21. The apparatus as recited in claim 14 wherein the housing comprises inner and outer cylindrical walls that are spaced apart to form the closed chamber there between, and first and second end walls extending between the inner and outer cylindrical walls.

22. The apparatus as recited in claim 20 wherein the first conduit is wound as a coil around the inner cylindrical wall.

23. The apparatus as recited in claim 14 further comprising a second conduit extending within the closed chamber of the housing and in contact with the refrigerant, the second conduit having an inlet and an outlet to enable a fluid to flow there between.

24. The apparatus as recited in claim 14 further comprising:

a source of the beverage connected to the beverage inlet of the first conduit; and a dispenser connected to the beverage outlet of the first conduit for dispensing the beverage into a container.

25. The apparatus as recited in claim 14 further comprising:

a dispenser connected to the beverage outlet of the first conduit for dispensing the beverage into a container, the dispenser having a storage chamber for the beverage and a cavity at least partially around the storage chamber, the cavity having a coolant inlet and a coolant outlet;

a second conduit extending within the closed chamber of the housing and in contact with the refrigerant;

a coolant fluid in the cavity of the dispenser and the second conduit; and a pump coupled to the dispenser and the second conduit to circulate the coolant fluid there between.

26. The apparatus as recited in claim 25 wherein the coolant fluid contains glycol.

27. The apparatus as recited in claim 25 further comprising a sensor which detects the temperature of the coolant fluid and provides a signal indicating that temperature to the controller.

* * * * *